United States Patent [19]

Dilg

[11] 4,279,083

[45] Jul. 21, 1981

[54] SHOE CONSTRUCTION WITH REPLACEABLE SOLE

[76] Inventor: Carl W. Dilg, 1715 N. 500 East, Provo, Utah 84601

[21] Appl. No.: 117,576

[22] Filed: Feb. 1, 1980

[51] Int. Cl.[3] ..... A43B 3/24

[52] U.S. Cl. ..... 36/101

[58] Field of Search ..... 36/100, 101, 50

[56] References Cited

U.S. PATENT DOCUMENTS

| | | | |
|---|---|---|---|
| 2,495,984 | 1/1950 | Roy | 36/101 |
| 4,062,132 | 12/1977 | Klimaszewski | 36/100 |
| 4,114,296 | 9/1978 | Smith | 36/101 |

*Primary Examiner*—Patrick D. Lawson

*Attorney, Agent, or Firm*—Thorpe, North, Western & Gold

[57] ABSTRACT

A shoe construction includes a shoe body which is conventional except that it does not include a shoe sole, a first layer of material fixed to the undersurface of the shoe body, a second layer of material for attaching to and detaching from the first layer of material, and a shoe sole fixed to the second layer of material. The first and second layers of material include means such as velcro for enabling attachment and detachment of the two layers. With this construction, when a shoe sole becomes worn, it can be detached from the shoe body and replaced by a new shoe sole.

9 Claims, 2 Drawing Figures

SHOE CONSTRUCTION WITH REPLACEABLE SOLE

BACKGROUND OF THE INVENTION

This invention relates to a shoe construction and more particularly to a shoe construction which enables easy attachment and detachment of the shoe sole.

It is typical that with most shoes, the sole will wear out before any other part of the shoe. For certain types of footwear such as dress shoes, boots, etc., it is possible to have the sole replaced by a shoe repairman and this gives the footwear a considerably longer useful life. However, with sports footwear such as various types of sneakers and running shoes, it is not possible to have the sole replaced if the sole wears out before the shoe body. Thus, when the shoe sole wears out, even though the location of the wear is in one small spot, the entire shoe and its mate must be thrown away. This is the case even though the upper part or shoe body is still in good condition.

SUMMARY OF THE INVENTION

It is an object of the invention to provide a shoe construction which will enable easy replacement of shoe soles for shoes such as sneakers and running shoes.

It is another object of the invention to provide a shoe construction wherein replaceable soles may be securely attached to a shoe body.

It is a further object of the invention to provide such a shoe construction in which a shoe sole may be readily detached from the shoe body or attached thereto without requiring the use of tools of any kind.

The above and other objects of the invention are realized in a specific illustrative embodiment thereof in which a shoe construction includes a conventional shoe body having an upper portion which fits about the top of a foot, and a lower portion which is joined to the upper portion and which fits under the foot. Also included is a first layer of material fixed to the under surface of the lower portion of the shoe body, the downward facing side of the first layer having elements, such as velcro, for enabling attachment to and detachment from a second corresponding layer of material. The shoe construction further includes a second layer of material, one side of which has elements, again such as velcro, for enabling attachment to and detachment from the first layer of material, and a shoe sole fixed to the other side of the second layer of material. With this construction, the second layer of material and attached shoe sole may be readily removed from the first layer of material and shoe body. This may be desired either to replace a worn sole or to provide a different type of sole or accommodating a different use for the shoe.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
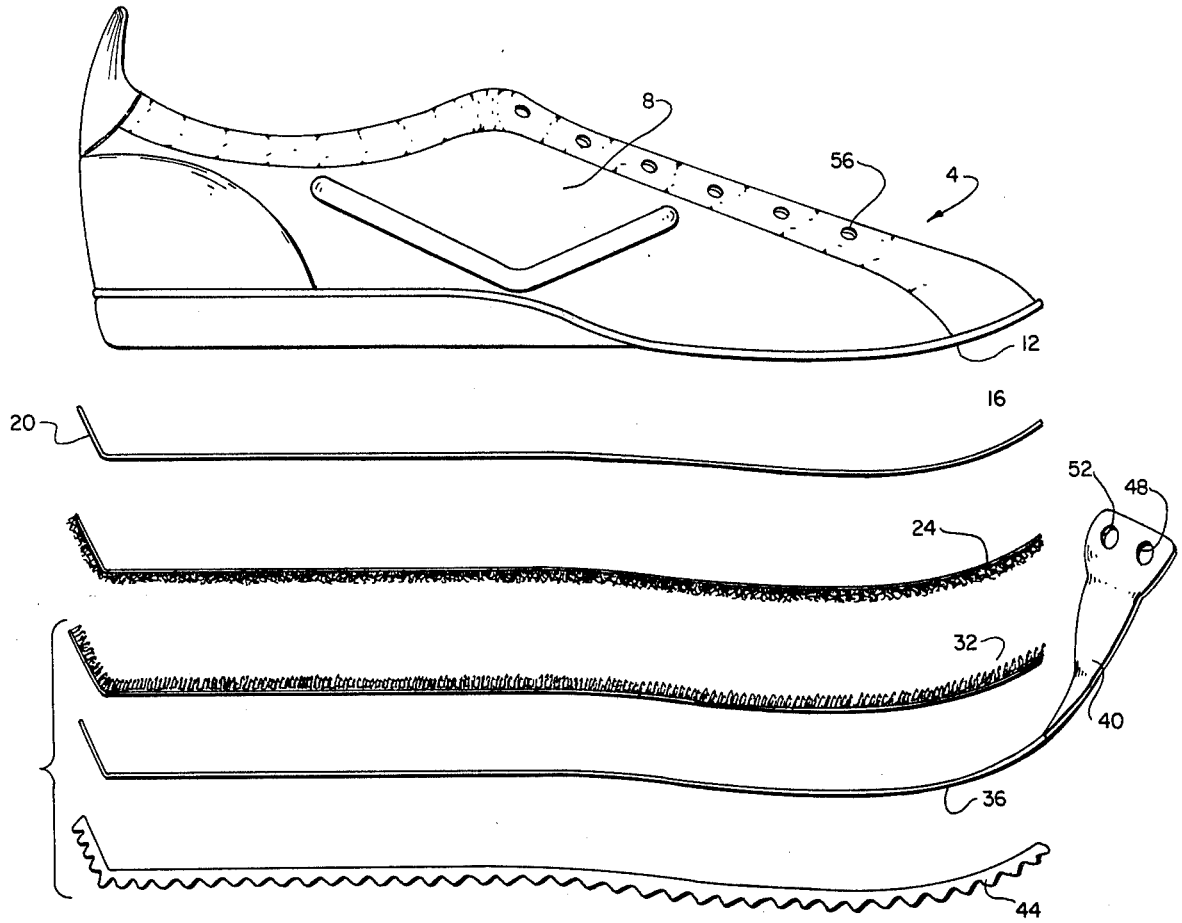
FIG. 1 shows an exploded view of a shoe construction made in accordance with the principles of the present invention.

Referring to FIG. 1, there is shown an exploded view of a shoe construction which includes a shoe body 4 of conventional design and having all parts of a shoe except for the sole. The shoe body 4 of FIG. 1 is similar to the shoe body of a conventional jogging shoe or sneaker, and includes an upper portion 8 which fits about the top of a person's foot and a lower portion 12, attached at its perimeter to the upper portion 8, which fits under a person's foot.

Permanently fixed to the lower portion 12 of the shoe body is a piece of material 16 made of canvas, sturdy denim, etc. The material 16 is cut so that its perimeter is contiguous with the perimeter of the lower portion 12 of the shoe body except that the rear or heel section of the material 16 includes a short extension 20 which extends up the rear or heel portion of the shoe body 4 a short distance. The material 16 may be attached to the lower portion 12 of the shoe body by conventional adhesive.

Permanently attached or fixed to the material 16 is a layer of velcro material 24, with the material being cut so that the perimeter thereof is contiguous with the perimeter of the material 16. The velcro 24 is affixed to the material 16 by a suitable adhesive. The layer of velcro 24 is shown in FIG. 1 to be comprised of conventional tightly formed loops of material. The shoe body 4, canvas or similar material 16, and velcro material 24 form the permanent or nonreplaceable portion of the shoe construction of the present invention. That portion of the shoe construction to next be described forms the replaceable portion.

The replaceable portion, indicated generally by the numeral 28, includes a second layer 32 of velcro material adapted for attachment to the first-mentioned layer 24. The velcro layer 32 is comprised of a plurality of hook-like elements which, as is well known, readily attach to and detach from the loops of layer 24. The layer of velcro 32 is cut so that the perimeter thereof is contiguous with the perimeter of the velcro layer 24.

The velcro layer 32 is permanently mounted on a layer of material 36 which is comprised of canvas, heavy denim, or similar material. The velcro layer 32 is fixed to the layer 36 by a suitable adhesive. The material 36 is cut so that its edges are contiguous with the edges of the velcro layer 32 except for a flap portion 40 which extends forwardly of the layer as shown in FIG. 1. The function of this flap portion 40 will be discussed momentarily.

Permanently attached to the under side of the layer 36 is a shoe sole 44 constructed of rubber or suitable synthetic composition typically used for sneaker or running shoe soles. The shoe sole 44 is permanently fixed to the layer 36 by a suitable adhesive and is formed so that the edges thereof are generally contiguous with the edges of the layer 36. The shoe sole 44, as well as the layers 36, 32, and 24, extend rearwardly a distance to enable the layers to overlap a portion of the rear of the shoe body 4. In the manner described, the velcro layer 32, canvas or denim layer 36 and shoe sole 44 form a unitary detachable portion 28 of the shoe construction.

The flap portion 40 is provided to better secure the detachable portion 28 of the shoe construction onto the permanent portion thereof. This is done by simply wrapping the flap portion 40 over the toe of the shoe body 4 so that a pair of openings 48 and 52 formed in the flap overlie shoe lace openings 56 in the shoe body.

Then, when the shoe body is laced up, shoe laces will extend also through openings 48 and 52 in the flap to secure the flap in the wrapped-over position and thereby better secure the detachable portion 28 onto the shoe body.

It should be understood that other means could be employed for detachably securing a shoe sole to a shoe body besides use of the velcro material described. For example, adhesives may be found which could be applied to the lower portion 12 of the shoe body 4 and the upper surface of the sole 44 so that the sole could be attached directly to the shoe body. Such adhesives would be adapted to maintain the sole 44 onto the shoe body 4 while also allowing detachment therefrom when pulled by the user of the shoe. Also, the flap 40 might be attached to the shoe lace openings 56 or to the shoe laces themselves by means of hooks or other suitable attachment structure, without the need for the use of openings 48 and 52.

The loop side velcro material 24 advantageously is included as part of the permanent portion of the shoe construction, whereas the hook side 32 is included as part of the detachable portion because the loop side tends to wear longer. Thus, that side of the velcro fastener which tends to wear out more quickly is included with the detachable portion 28 of the shoe construction so that it may be thrown away along with the worn out sole 44.

Figure 2:
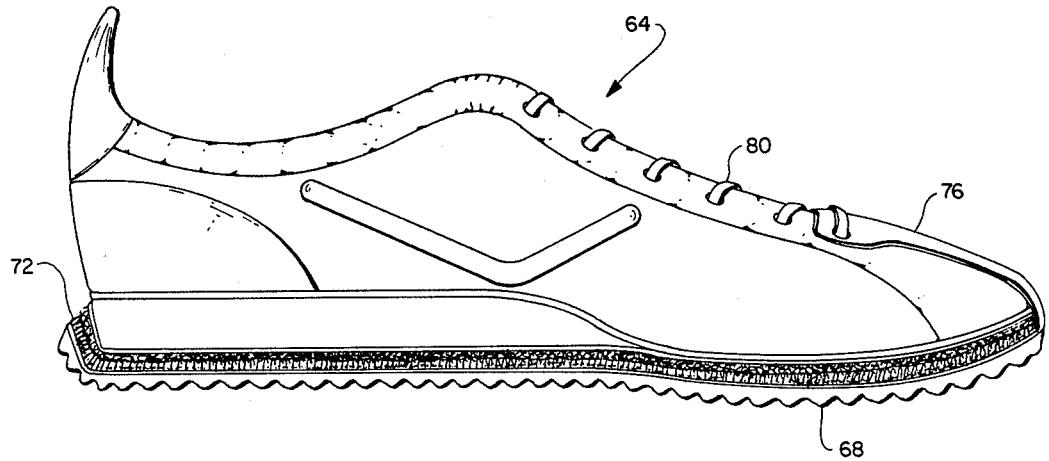
FIG. 2 shows a shoe construction in which the front flap of the attachable sole portion extends forwardly of the shoe sole itself.

FIG. 2 shows an alternative embodiment of the shoe construction of the present invention to include a shoe body 64, a detachable shoe sole 68, and a suitable attachment mechanism 72 disposed between the shoe body 64 and the shoe sole 68. With the embodiment of FIG. 2, the shoe sole 68 is formed with a flap portion 76 which extends forwardly of the sole to wrap around the toe of the shoe body 64 for securement with shoe laces 80 as previously described. In other words, the flap portion 76 is constructed as part of the shoe sole, rather than some intermediate layer as in the FIG. 1 embodiment.

With the shoe construction described, shoe soles may be readily replaced when the sole wears out without having to also throw away what may still be a usable shoe body. Also, if a person desires to use different types of shoe soles for different activities, the shoe construction of the present invention allows a person to readily change shoe soles to accommodate the desired activity. In this manner, a single shoe body could be sold and used with a number of different shoe soles.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A shoe construction comprising a shoe body having an upper portion which fits about the top of a foot, and a lower portion which is joined at its perimeter to the upper portion and which fits under the foot, a first layer of material permanently fixed at its upper side to the undersurface of said lower portion of the shoe body and having a perimeter which is contiguous with the perimeter of the lower portion of the shoe body, the side of said first layer which faces downwardly including a layer of attachment means having a perimeter substantially contiguous with said first layer perimeter for attaching to and detaching from a second corresponding layer of detachable material, a layer of detachable material, one side of which includes a layer of attachment means having a perimeter substantially contiguous with said first layer perimeter for attaching to and detaching from the first layer of material, and a shoe sole permanently fixed to the other side of said second layer of material.

2. A shoe construction as in claim 1 wherein said first and second layers of material are comprised of velcro.

3. A shoe construction as in claim 2 wherein said first layer is comprised of a plurality of tightly formed loops, and wherein said second layer is comprised of a plurality of hook elements adapted to attach to the loops when pressed thereagainst.

4. A shoe construction as in claim 1 further comprising a third layer of material disposed between the second layer of material and the shoe sole, said third layer including a flexible flap portion which projects out from between the second layer and which, in turn, includes means for fastening the flap portion to the upper portion of the shoe body to thereby aid in maintaining the second layer in attachment to the first layer.

5. A shoe construction as in claim 4 wherein said flap portion projects from between the second layer and the shoe sole forwardly to attach to the front of the upper portion of the shoe body.

6. A shoe construction as in claim 5 wherein said shoe body includes means for accommodating shoe laces for securing the shoe body onto a person's foot, and wherein said fastening means comprises an opening in the flap portion through which a shoe lace may be threaded.

7. A shoe construction as in claim 1 wherein said shoe sole includes a flap portion which extends forwardly of the shoe sole and includes means for fastening the flap portion to the upper portion of the shoe body.

8. A shoe construction as in claim 5 wherein said shoe body includes means for accommodating shoe laces for securing the shoe body onto a person's foot, and wherein said fastening means comprises an opening in the flap portion through which a shoe lace may be threaded.

9. A shoe construction as in claim 7 or claim 8 wherein said shoe body includes means for accommodating shoe laces for securing the shoe body onto a person's foot, and wherein said fastening means comprises an opening in the flap portion through which a shoe lace may be threaded.

* * * * *